US007066767B2

(12) United States Patent
Liao

(10) Patent No.: US 7,066,767 B2
(45) Date of Patent: Jun. 27, 2006

(54) ROTATABLE ADAPTER DEVICE WITH MULTIPLE CONNECTORS

(76) Inventor: Sheng-Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 11/086,454

(22) Filed: Mar. 23, 2005

(65) Prior Publication Data

US 2006/0073725 A1 Apr. 6, 2006

(30) Foreign Application Priority Data

Oct. 1, 2004 (TW) ..... 93215637 U

(51) Int. Cl.
*H01R 25/00* (2006.01)
*H01R 27/02* (2006.01)

(52) U.S. Cl. ..... 439/639; 439/640; 439/13

(58) Field of Classification Search ..... 439/639, 439/13, 11, 25, 24, 640, 21, 23
See application file for complete search history.

(56) References Cited

U.S. PATENT DOCUMENTS

| | | | | |
|---|---|---|---|---|
| 4,743,999 | A * | 5/1988 | Hames | 361/56 |
| 5,957,701 | A * | 9/1999 | McMillin | 439/13 |
| 6,118,643 | A * | 9/2000 | Dyer et al. | 361/111 |
| 6,488,510 | B1 * | 12/2002 | Li | 439/13 |
| 6,612,875 | B1 * | 9/2003 | Liao | 439/675 |
| 6,709,297 | B1 * | 3/2004 | Lee | 439/638 |
| 6,862,403 | B1 * | 3/2005 | Pedrotti et al. | 392/395 |

* cited by examiner

*Primary Examiner*—Hae Moon Hyeon
(74) *Attorney, Agent, or Firm*—Rosenberg, Klein & Lee

(57) ABSTRACT

A rotatable adapter device with multiple connectors includes a main body, a first electrical connector, a plurality of second electrical connectors and a conducting unit. The first electrical connector is disposed rotatably on the main body, the plurality of second electrical connectors are disposed fixedly on the main body and the conducting unit is electrically connected to the first electrical connector and at least one of the second electrical connectors. Therefore, it has a transforming function and is more convenient for a user. Moreover, its design avoids the signal lines becoming intertwined with each other when they are inserted into the adapter.

12 Claims, 6 Drawing Sheets

ROTATABLE ADAPTER DEVICE WITH MULTIPLE CONNECTORS

BACKGROUND OF THE INVENTION

1. Field of the Invention

The present invention relates to a rotatable adapter device with multiple connectors, and more particularly, to a rotatable adapter device with multiple connectors having a transforming function, that is more convenient and avoids the signal lines from becoming intertwined when a device is electrically connected with the adapter device with multiple connectors.

2. Description of Related Art

When a conventional signal line 80 is electrically connected to an electronic device, generally the plug 81 of one end of the signal line (see FIG. 7) is inserted into a corresponding socket of the electronic device. The signal line 80 and the electronic device are electrically connected to each other via the plug 81 which is connected to a socket. However, the plug 81 of one end of the signal line 80 and the socket of the electronic device often have different standards and types. So when the plug 81 is electrically connected to the socket through the adapter 82, with only a single standard and type, it is inconvenient for the user.

Because of the above defects, many adapter devices with multiple adapters have been developed. The main body 91 of the adapter device 90 has a socket and multiple plugs 92 (FIG. 8). The plug 92 has many different kinds of standards and types, and the plug 92 and the socket on the main body 91 are electrically connected to each other. Thus, the plug 94 of one end of the signal line 93 is correspondingly inserted into the socket of the adapter device 90 to electrically connect the signal line 93 to the adapter device 90. Furthermore, a suitable plug 92 on the adapter device 90 could be inserted selectively into the socket of the electrical device 95, electrically connecting the signal line 93 to the electronic device 95 through the adapter device 90. However, between the socket and the plug 92 of the adapter device 90 is a fixed structure. If the selection plug 92 of the adapter device 90 is placed near to the signal line 93, the signal line 93 impedes the plug 92 of the adapter device 90 and the socket of the electrical device 95 from being inserted into their respective sockets, thereby causing inconvenience to the user.

Accordingly, as discussed above, the prior art has some drawbacks that could be improved upon. The present invention aims to resolve the drawbacks in the prior art.

SUMMARY OF THE INVENTION

An objective of the present invention is to provide a rotatable adapter device with multiple connectors, that is more convenient and avoids impeding the insertion of the signal lines, so that it is easy to connect the adapter and the electronic device.

For reaching the objective above, the present invention provides a rotatable adapter device with multiple connectors that includes a main body and a first electrical connector disposed rotatably on the main body; a plurality of second electrical connectors are disposed fixedly on the main body; a conducting unit is electrically connected to the first electrical connector and at least one second electrical connector.

The present invention has at least one second electrical connector 3 comprised of different standards and types for electrically connecting to an electronic device, thus making the adapter more convenient. Moreover, between the first electrical connector 2 and the second electrical connectors 3 is a rotatable structure designed to avoid signal lines becoming intertwined. Therefore inserting other electronic devices into the sockets of the adapter is also convenient for the user.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
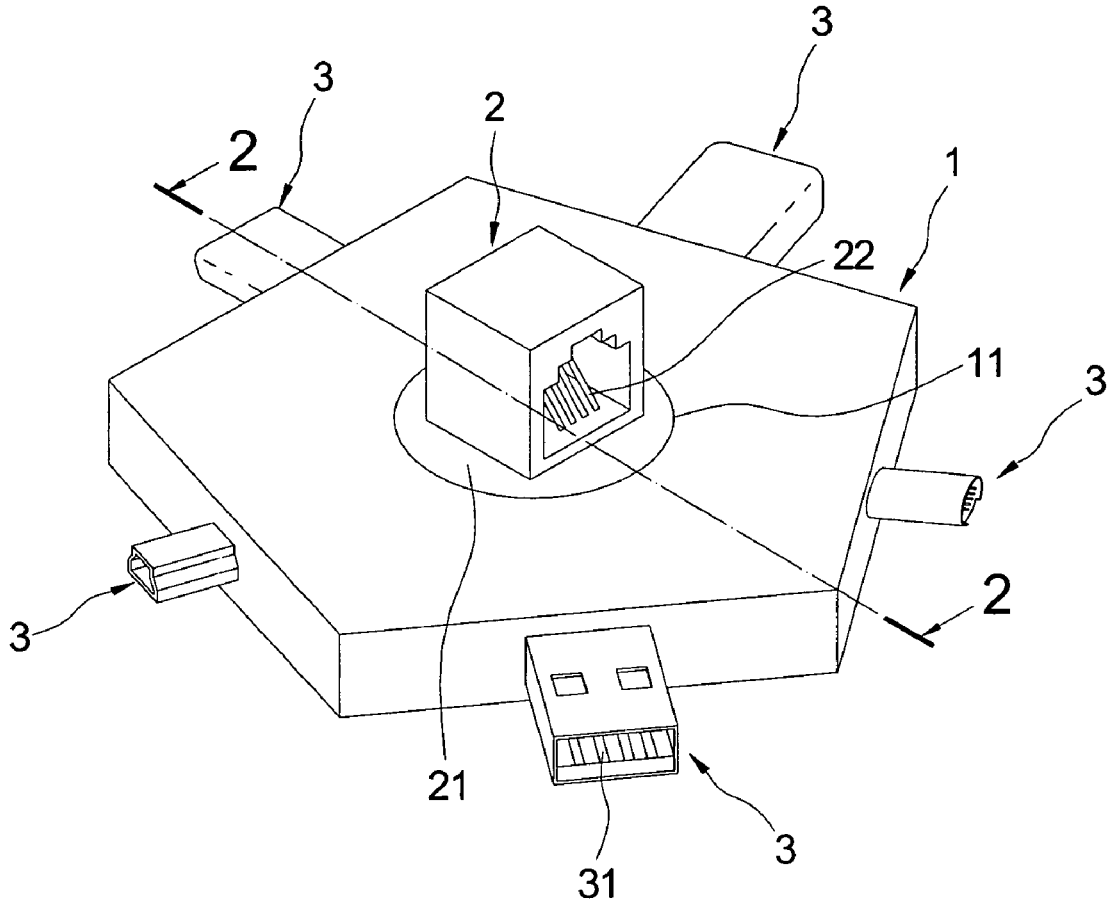
FIG. 1 is a perspective view of a rotatable adapter device with multiple connectors in accordance with a first embodiment of the present invention.
Figure 2:
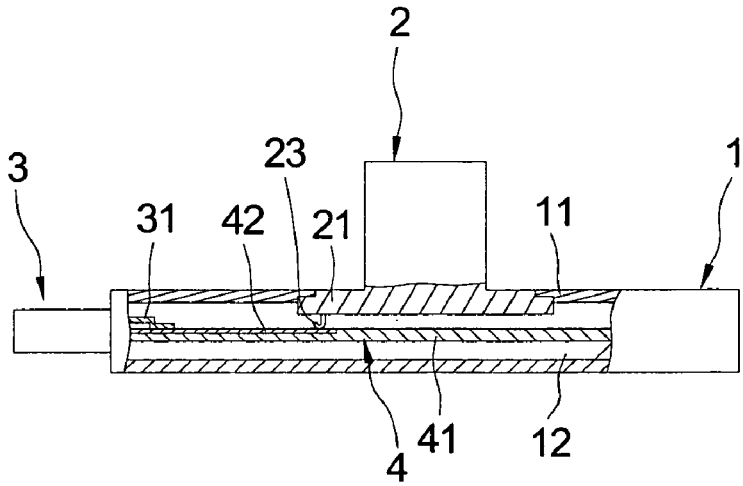
FIG. 2 is a cross-sectional view of FIG. 1

Referring to FIG. 1 and FIG. 2, a rotatable adapter device with multiple connectors includes a main body 1, a first electrical connector 2, a plurality of second electrical connectors 3 and a conducting unit 4. The main body 1 is a hollow housing that is made of a plastic material. It has a polygonal, circular or other shape, but the shape of the main body 1 is not limited. Moreover the main body 1 is integrally formed in one piece or formed by combining a top casing and a bottom casing together. The main body 1 is pentagon-shaped corresponding to the number of second electrical connectors 3. The main body 1 has a circular assembly hole 11 on a top portion thereof into which the first electrical connector 2 can be disposed. Furthermore the main body 1 has a receiving space 12 formed therein. The receiving space 12 communicates with the assembly hole 11 for accommodating a conducting unit 4 or other device.

The first electrical connector 2 is a socket, a plug, or an electrical connector of another type. The first electrical connector 2 is disposed in a horizontal or a vertical manner. The first electrical connector 2 is a socket, and it is disposed in an horizontal manner. The first electrical connector 2 has a circular rotation seat under a bottom portion thereof. The circular rotation seat connects rotatably in the assembly hole 11 of the top portion of the main body 1. The first electrical connector 2 is disposed rotatably on the main body 1; the first electrical connector 2 has a plurality of signal terminals 22 which are made of conductive materials for transmitting signals, and the signal terminals 22 are connected to a contacting portion 23 respectively. The contacting portion 23 is extended into the receiving space 12 of the main body 1; it is selectively electrically connected to the second electrical connectors.

The second electrical connectors can be composed of many different types and standards of electrical connectors, such as plugs, sockets or other electrical connectors (such as USBs or IEEE 1394 electrical connectors). The second electrical connectors 3 are disposed fixedly on the main body 1. The second electrical connectors 3 have a plurality of signal terminals 31 respectively which are made of a conductive material for transmitting signals.

The conducting unit 4 is disposed in the receiving space 12. The conducting unit 4 is electrically connected to the first electrical connector and at least one of the second electrical connectors 3. The conducting unit 4 is a circuit and a conducting wire type. In the present embodiment, the conducting unit 4 is a circuit type, and the conducting unit 4 has a circuit board 41. Moreover the circuit board 41 has a plurality of lines 42 formed on it by printing, electroplating or a chemical deposition manner for example. The first ends of the lines 42 are electrically connected to the signal terminals 31 of the second electrical connectors 3 respectively. The second ends of the lines 42 are placed in a movement path of the contacting portion 23 of the first electrical connector 2 respectively. When the first electrical connector 2 is rotated, the contacting portion 23 of the first electrical connector 2 moves in a circular motion around the axis of the rotation seat 21, and the contacting portion 23 is selectively contacted and conducted to all of the lines 42 on the circuit board 41. Thus the contacting portion 23 of the first electrical connector 2 is electrically connected to the signal terminals 31 of the second electrical connectors 3 correspondingly through the lines 42 on the circuit board 41, and is the first electrical connector 2 selectively electrically connected to one of the second electrical connectors 3. If the conducting unit 4 is a conducting wire type, the first electrical connector 2 is connected to one of the second electrical connectors 3 by conducting wires.

Figure 3:
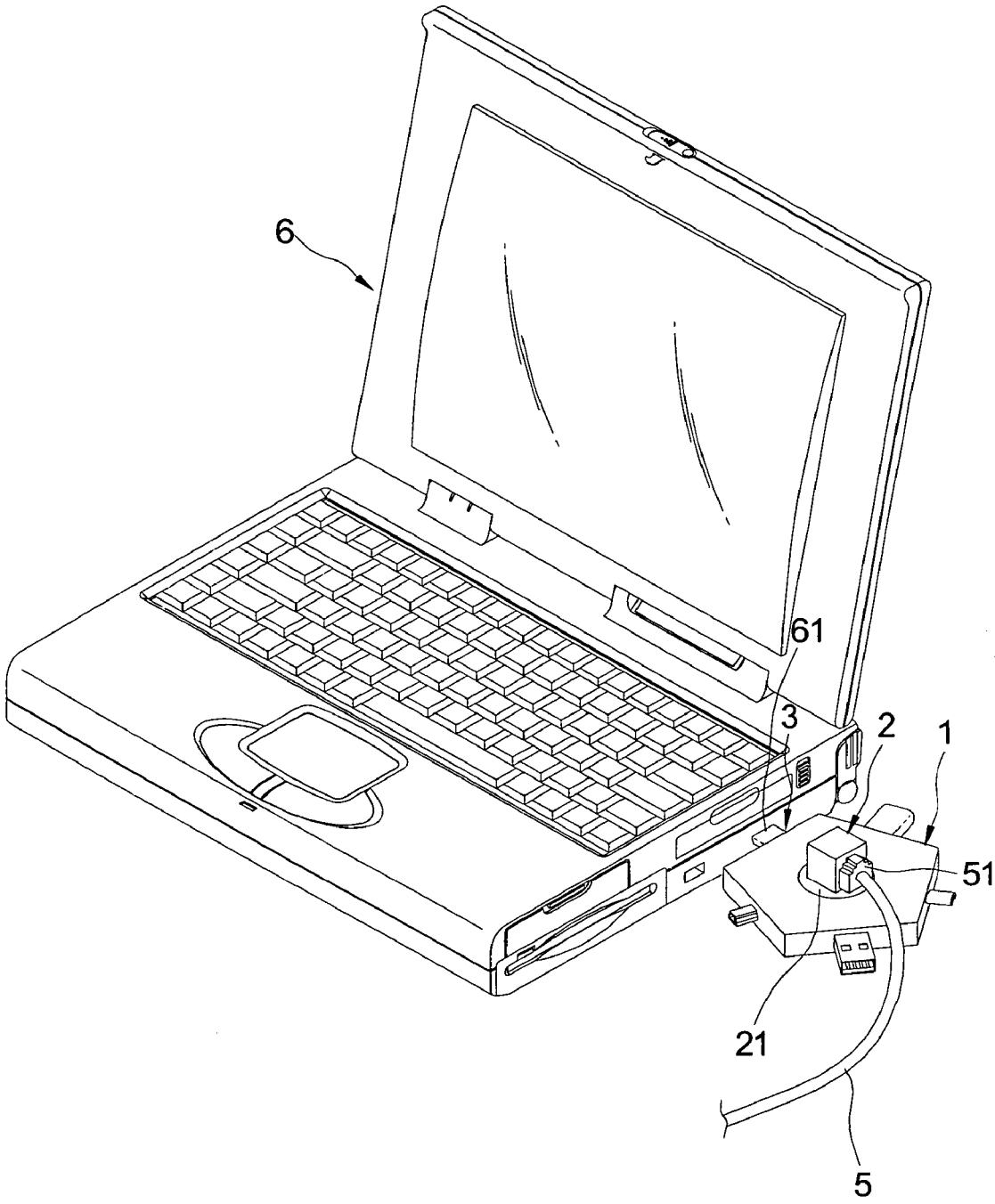
FIG. 3 is a schematic view of a rotatable adapter device with multiple connectors in accordance with a first embodiment of the present invention.

Referring to FIG. 3, a third electrical connector (plug) 51 of one end of the signal line 5 is inserted into the first electrical connector 2 of the adapter device of the present invention. The signal line 5 is electrically connected to the adapter device. The second electrical connectors 3 of the adapter device 6 are selectively inserted into a fourth electrical connector of the electronic device, and the signal line 5 is electrically connected to an electronic device 6 through the adapter device.

Figure 4:
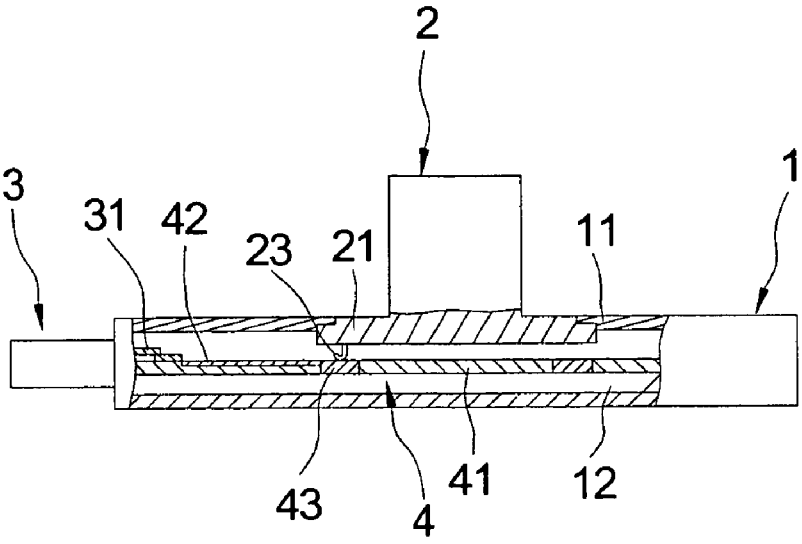
FIG. 4. is a cross-sectional view of a rotatable adapter device with multiple connectors in accordance with a second embodiment of the present invention.

In addition, referring to FIG. 4, the second end of the lines 42 on the circuit board 41 of the conducting unit 4 is connected to a circular track 43 of continuous annularity. The circular track 43 is electrically connected to all of the second electrical connectors 3 at the same time through the lines 42. The circular track 43 of the second end of the lines 42 are placed in the movement path of the contacting portion 23 of the first electrical connector 2. As the first electrical connector 2 is rotated, the contacting portion 23 of the first electrical connector 2 moves in a circular motion around the axis of the rotation seat 21, and the contacting portion 23 is selectively contacted and conducted to all of the lines 42 on the circuit board 41 through the circular track 43. Moreover the contacting portion 23 of the first electrical connector 2 is electrically connected to the signal terminals 31 of all of the second electrical connectors 3 through the lines 42 on the circuit board 41 and the circular track 43. Thus the first electrical connector 2 is electrically connected to all of the second electrical connectors 3 at the same time.

Figure 5:
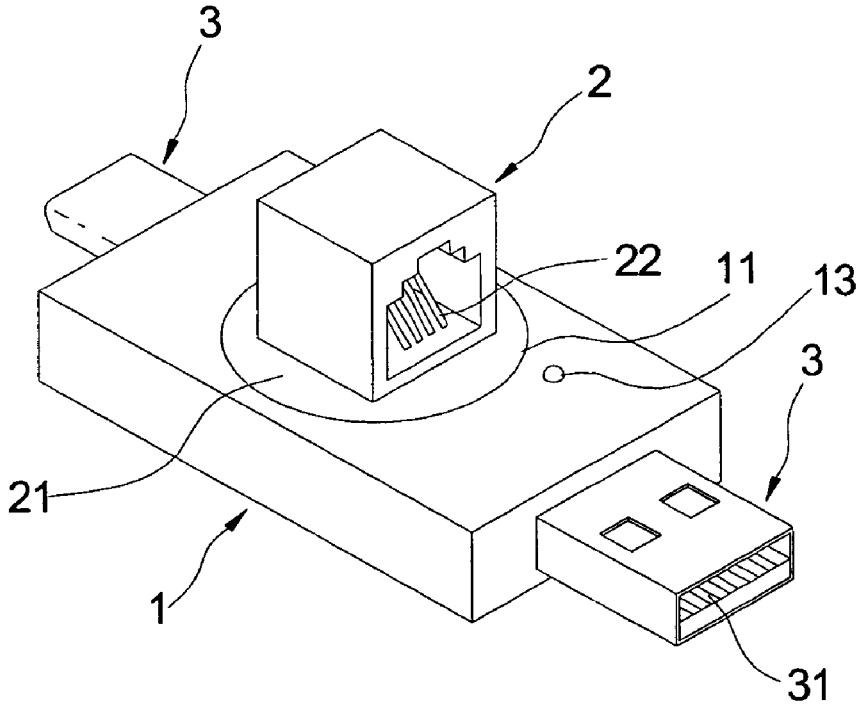
FIG. 5 is a perspective view of a rotatable adapter device with multiple connectors in accordance with a third embodiment of the present invention.

Referring to FIG. 5, in the present embodiment, the main body 1 is rectangle in shape. It has two second electrical connectors 3, and they are disposed fixedly at two ends of the main body 1 respectively. The main body 1 has a display light 13 that is used to display whether the device is turned on or not.

Figure 6:
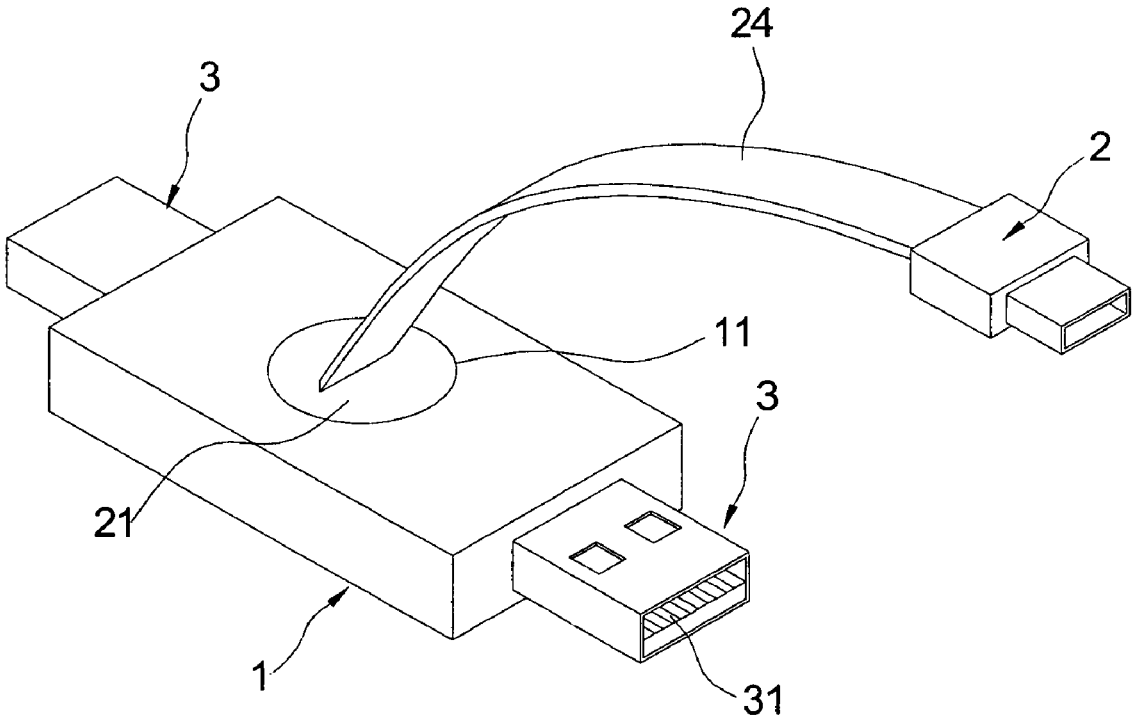
FIG. 6 is a perspective view of a rotatable adapter device with multiple connectors in accordance with a fourth embodiment of the present invention.
Figure 7:
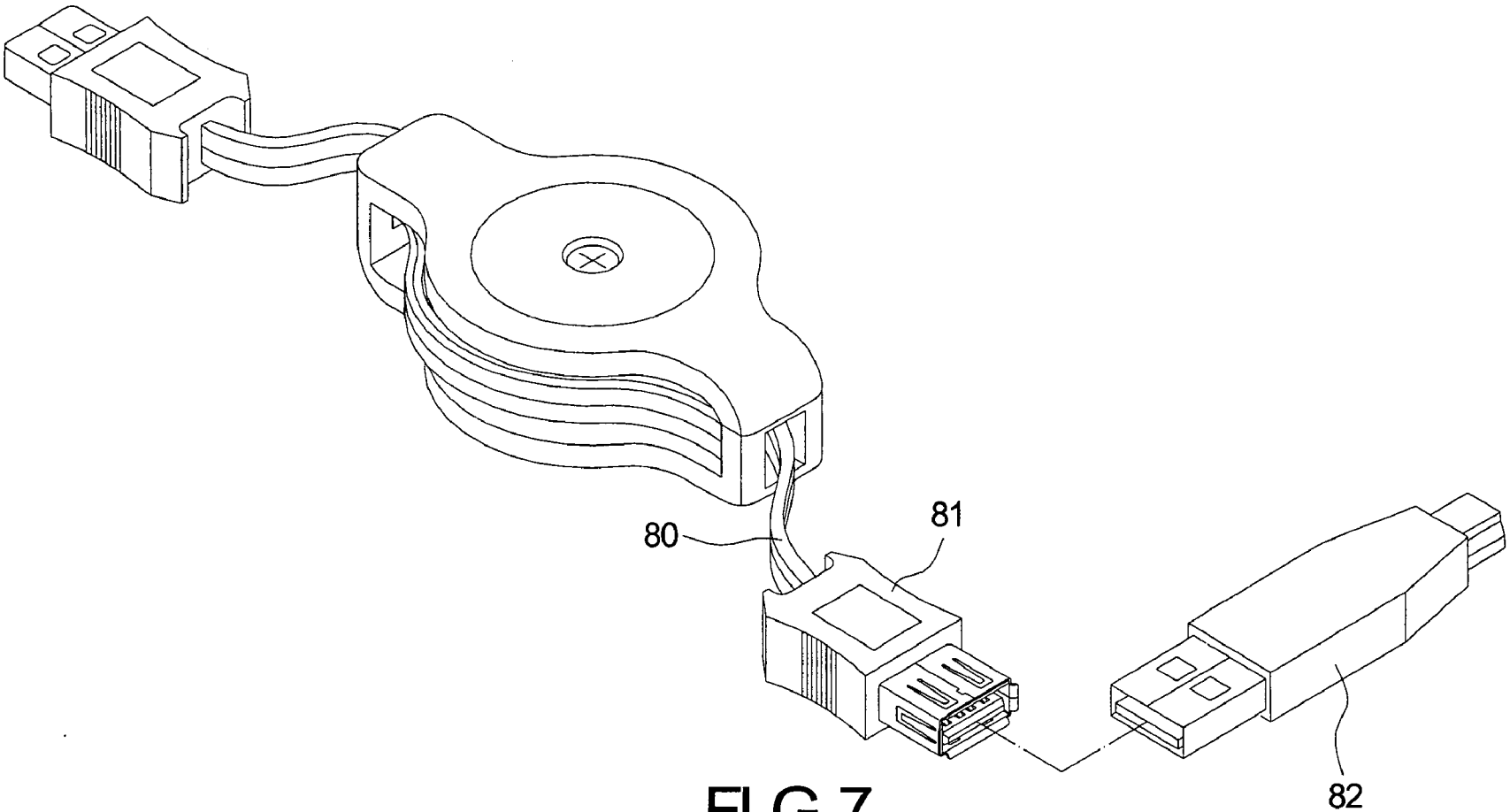
FIG 7 PRIOR ART
FIG. 7 is a schematic view of an adapter of the prior art.
Figure 8:
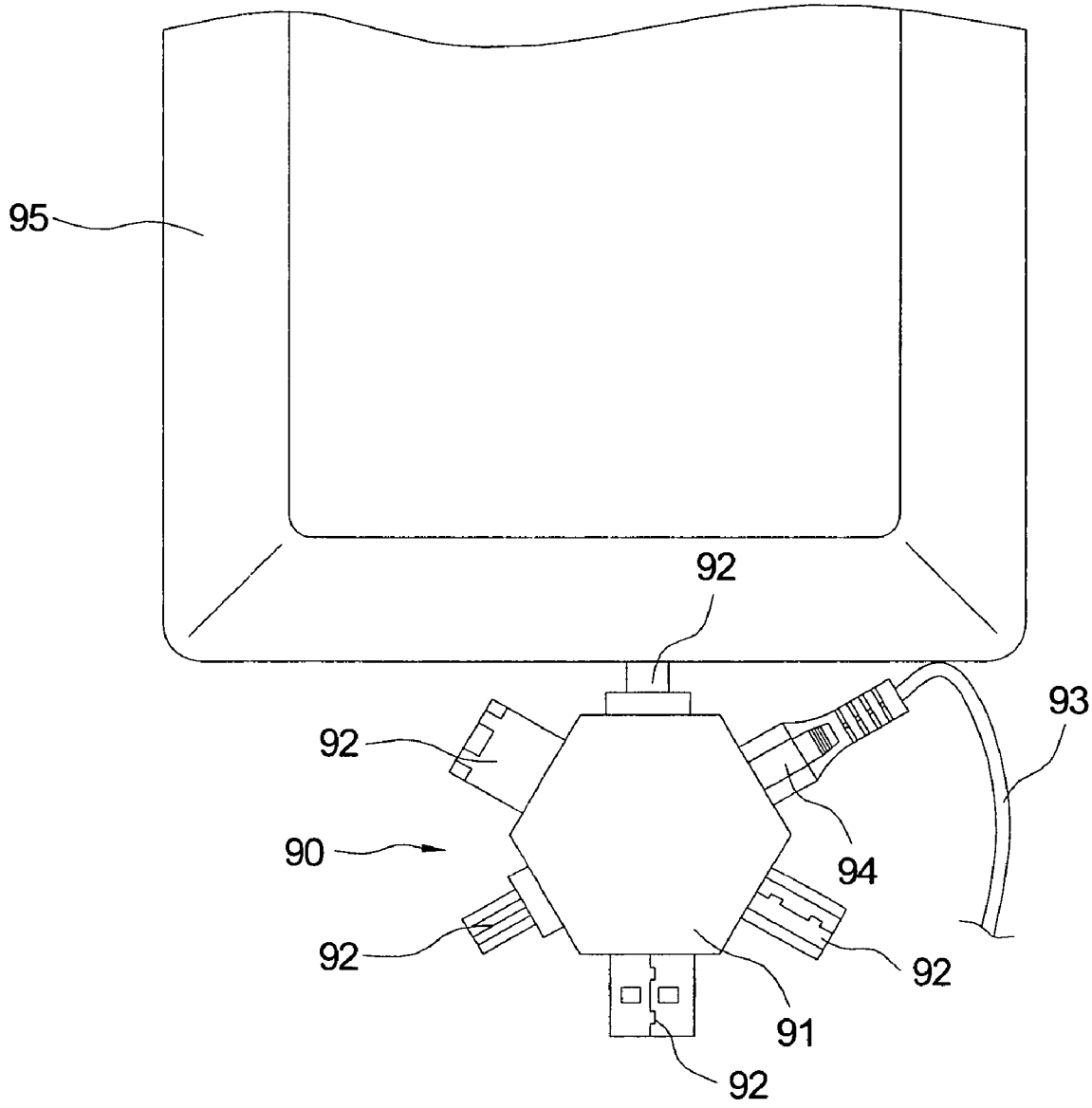
FIG. 8 PRIOR ART
FIG. 8 is a schematic view of an adapter device of the prior art.

Referring to FIG. 6 the first electrical connector 2 is connected to the rotation seat 21 and the conducting unit 4 by the signal lines 24.

The present invention has second electrical connectors 3 of many different standards and types for electrically connecting to the electronic device, and thus it is more convenient for the user. Moreover, between the first electrical connector 2 and the second electrical connectors 3 is a rotatable structure. Hence, as one of the second electrical connectors 3 of the transformation device is inserted into the fourth electrical connector 61 of the electronic device 6, the signal line 5 won't become intertwined during the insertion process. Connection electronic devices with the adapter device is thereby easy and convenient.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are embraced within the scope of the invention as defined in the appended claims.

What is claimed is:

1. A rotatable adapter device with multiple connectors, comprising:

a main body;

a first electrical connector disposed rotatably on the main body;

a plurality of second electrical connectors disposed fixedly on the main body, at least one of the second electrical connectors being different in connector type from another; and a conducting unit electrically coupling the first electrical connector to at least one second electrical connector in selective manner responsive to rotation of the first electrical connector.

2. The rotatable adapter device with multiple connectors as claimed in claim 1, wherein the main body is integrally formed in one piece.

3. The rotatable adapter device with multiple connectors as claimed in claim 1, wherein the main body is formed by combining a top casing and a bottom casing together.

4. The rotatable adapter device with multiple connectors as claimed in claim 1, wherein the main body has a circular assembly hole on a top portion thereof, the first electrical connector has a circular rotation seat under a bottom portion thereof, the circular rotation seat connects rotatably in the assembly hole of the top portion of the main body.

5. The rotatable adapter device with multiple connectors as claimed in claim 1, wherein the main body has a receiving space formed therein, the first electrical connector has a plurality of signal terminals; the signal terminals are connected through a contacting portion respectively, the contacting portion is extended into the receiving space, the conducting unit is disposed in the receiving space and the conducting unit has a circuit board; the circuit board has a plurality of lines, the lines have a plurality of first ends and second ends, the first ends of the lines are electrically connected to the second electrical connectors, the second ends of the lines are placed in a movement path of the contacting portion of the first electrical connector, when the first electrical connector is rotated, the contacting portion is selectively contacted and conducted to the lines of the circuit board, the first electrical connector is selectively electrically connected to the second electrical connectors.

6. The rotatable adapter device with multiple connectors as claimed in claim 1, wherein the first electrical connector is a socket, a plug or an electrical connector.

7. The rotatable adapter device with multiple connectors as claimed in claim 1, wherein the first electrical connector is disposed in a horizontal or a vertical manner.

8. The rotatable adapter device with multiple connectors as claimed in claim 1, wherein the second electrical connectors are sockets, plugs or electrical connectors.

9. The rotatable adapter device with multiple connectors as claimed in claim 1, wherein the main body has a display light.

10. The rotatable adapter device with multiple connectors as claimed in claim 1, wherein the first electrical connector is connected to the conducting unit by a signal line.

11. A rotatable adapter device with multiple connectors, comprising:

a main body;

a first electrical connector disposed rotatably on the main body;

a plurality of second electrical connectors disposed fixedly on the main body, at least one of the second electrical connectors being different in connector type from another; and a conducting unit electrically connected to the first electrical connector and to at least one second electrical connector;

wherein the main body has a receiving space formed therein, the first electrical connector has a plurality of signal terminals; the signal terminals connect to a contacting portion respectively, the contacting portions are extended into the receiving space, the conducting unit is disposed in the receiving space, the conducting unit has a circuit board; the circuit board has a plurality of lines, the lines have a plurality of first ends and second ends, the first ends of the lines are electrically connected to the second electrical connectors, the second ends of the lines are connected to a circular track of continuous annularity, the circular track is electrically connected to all of the second electrical connectors at the same time through the lines; the circular track is placed in the movement path of the contacting portion of the first electrical connector, the contacting portion being slidably displaceable along the circular track responsive to rotation of the first electrical connector to maintain electrical connection thereto, whereby the contacting portion of the first electrical connector is electrically connected to all of the second electrical connectors at the same time through the lines and the circular track of the circuit board.

12. A rotatable adapter device with multiple connectors, comprising:

a main body;

a first electrical connector disposed rotatably on the main body;

a plurality of second electrical connectors disposed fixedly on the main body, at least one of the second electrical connectors being different in connector type from another;

a conducting unit electrically coupling the first electrical connector to at least one second electrical connector in selective manner responsive to rotation of the first electrical connector; and, a display light actuable responsive to rotation of the first electrical connector to indicate a state of electrical coupling between a preselected one of the second electrical connectors and the first electrical connector.

* * * * *